US009713221B2

(12) United States Patent
Ross

(10) Patent No.: US 9,713,221 B2
(45) Date of Patent: Jul. 18, 2017

(54) LUMINAIRE

(75) Inventor: Philip Roland Ross, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 406 days.

(21) Appl. No.: 12/995,878

(22) PCT Filed: May 13, 2009

(86) PCT No.: PCT/NL2009/000113

§ 371 (c)(1),
(2), (4) Date: Apr. 18, 2011

(87) PCT Pub. No.: WO2009/148300

PCT Pub. Date: Dec. 10, 2009

(65) Prior Publication Data

US 2011/0181207 A1 Jul. 28, 2011

(30) Foreign Application Priority Data

Jun. 5, 2008 (NL) ..... 1035544

(51) Int. Cl.
*F21V 23/04* (2006.01)
*H05B 33/08* (2006.01)
*H05B 37/02* (2006.01)

(52) U.S. Cl.
CPC ..... *H05B 33/0863* (2013.01); *H05B 37/029* (2013.01)

(58) Field of Classification Search
CPC ..... H05B 33/0863; H05B 33/0833; H05B 33/0845; F21V 23/0442; H03K 17/962; Y10S 362/802
USPC ..... 362/276, 410, 249.01, 249.02, 249.05, 362/230, 231; 200/600; 340/407.1, 340/407.2; 345/173; 116/205
See application file for complete search history.

(56) References Cited

U.S. PATENT DOCUMENTS 2,632,098 A * 3/1953 Marchese ..... 362/395
4,751,625 A * 6/1988 Lin ..... 362/276
(Continued)

FOREIGN PATENT DOCUMENTS

WO WO 2004100613 A1 * 11/2004
WO WO 2007/072315 A1 6/2007
WO WO 2008/038179 A2 4/2008

OTHER PUBLICATIONS

International Search, Sep. 8, 2009.

*Primary Examiner* — Peggy Neils
*Assistant Examiner* — William N Harris

(57) ABSTRACT

The invention relates to a luminaire provided with a housing with light-emitting elements which are located near a light emission side of the housing and which are activated in that a user touches one or more sensors accommodated in a wall of the housing. Usually such luminaires are switched on and off by a user using a switch provided in or near the house. It is an object of the invention to provide a luminaire of which many variables, such as the intensity, the beam width, and the color of the light emitted during operation, can be adjusted by a user in a simple manner. According to the invention, a luminaire for this purpose is proposed wherein the sensors are arranged multidimensionally, and the number of activated light-emitting elements corresponds to the size of the wall surface including sensors that is touched by the user.

11 Claims, 3 Drawing Sheets

(56) References Cited

U.S. PATENT DOCUMENTS

Figure 1:
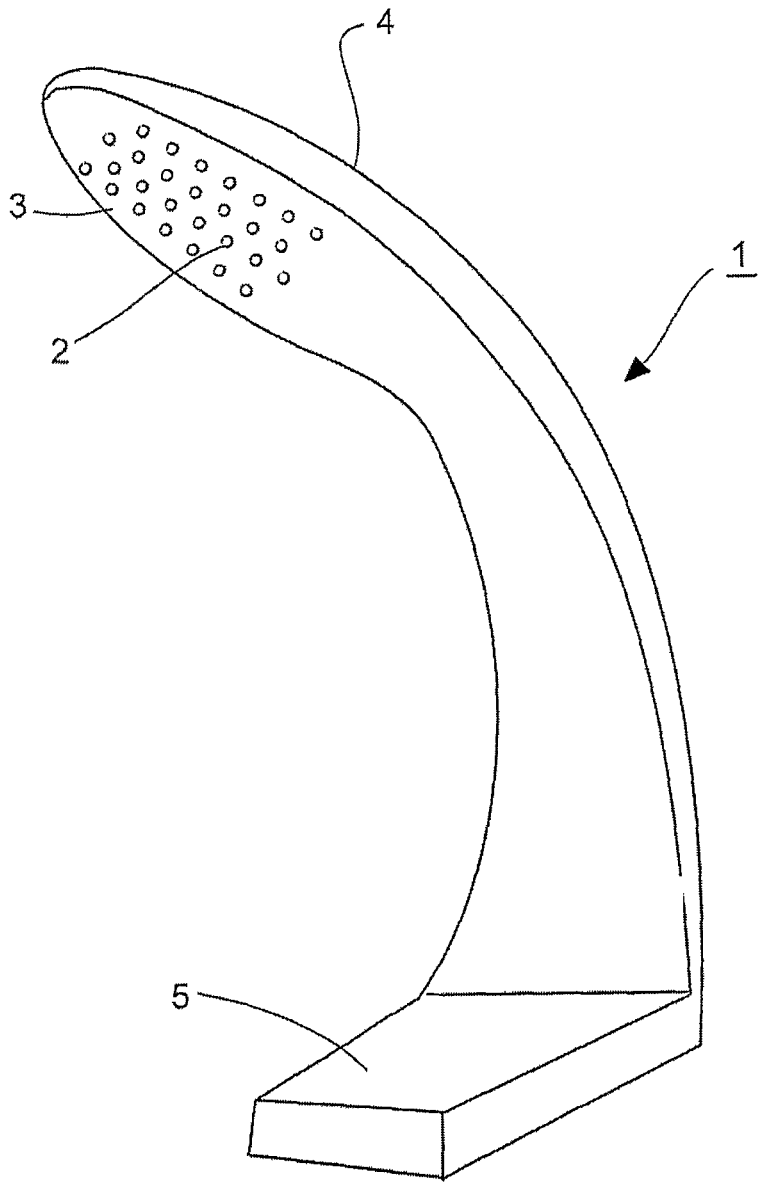

| | | | | |
|---|---|---|---|---|
| 7,054,133 | B2 * | 5/2006 | Orth | 361/278 |
| 7,547,119 | B2 * | 6/2009 | Kuwana et al. | 362/294 |
| 8,044,415 | B2 * | 10/2011 | Messere et al. | 257/88 |
| 2002/0159267 | A1 * | 10/2002 | Hao | 362/394 |
| 2005/0248299 | A1 * | 11/2005 | Chemel et al. | 315/312 |
| 2006/0245200 | A1 * | 11/2006 | Kuwana et al. | 362/488 |
| 2007/0152984 | A1 * | 7/2007 | Ording et al. | 345/173 |

* cited by examiner

LUMINAIRE

CROSS-REFERENCE TO RELATED APPLICATIONS

The present application claims the benefit of priority to International Patent Application No. PCT/NL2009/000113 filed 13 May 2009, which further claims the benefit of priority to Dutch Patent Application No. 1035544 filed 5 Jun. 2008, the contents of which are incorporated herein by reference in their entirety.

DESCRIPTION

The invention relates to a luminaire provided with a housing with light-emitting elements which are located near a light emission side of the housing and which are activated in that a user touches one or more sensors accommodated in a wall of the housing.

Luminaires are used both for interior and for outdoor lighting. The known luminaires for interior lighting (such as those for use in a home or an office) are usually provided with (halogen) incandescent lamps or fluorescent lamps arranged in the housing of the luminaire. The lamps are switched on and off by a user by means of a switch provided in or near the house.

Nowadays, however, various more compact light-emitting elements such as light-emitting diodes (LEDs) are increasingly used in luminaires because of the high luminous efficacy and long operational life of these light sources. Since these light sources are so compact, luminaires can now be used having shapes and dimensions that were practically impossible with conventional lamps.

The influencing and control of the light output of lamp systems and luminaires by means of plates or surfaces with sensors sensitive to touch is known, for example, from the published American patent application US 2002/0159267. A touch sensor with a brightness control for light sources is described therein for which a tactile plate is used, for example made of glass or synthetic resin.

The light source can be switched on or off in that the plate is touched. In an embodiment, said plate is coupled to an electric circuit by means of which a user can adjust the intensity of the light sources. The intensity of the light can be adjusted as desired by a user with such a plate, which has the function of an electronic panel. Such a plate is situated in a location at some distance from the housing with the light sources. This occupies more space, which may be inconvenient for the user.

There are also elongate luminaires in which LEDs arranged in a row are individually coupled to respective sensors placed behind them such that the LEDs emit light when a user touches the respective sensor with his/her hand. Such a one-dimensional arrangement offers the user few possibilities of influencing the beam shape of the emitted light in accordance with his/her own wishes.

It is an object of the invention to provide a luminaire of which many variables, such as the intensity, the beam width, and the colour of the light emitted during operation, can be adjusted by a user in a simple manner.

According to the invention, a luminaire for this purpose is characterised in that the sensors are arranged multidimensionally, and the number of activated light-emitting elements is proportional to the size of the wall surface comprising sensors that is touched by the user.

Given a multidimensional arrangement of the sensors such as, for example, on a two-dimensional sensor surface in the wall of the housing, many possibilities for the output of characteristic shapes of light emitted by the luminaire can be realised upon a touch by a user. In the case of a three-dimensional arrangement of sensors there may be, for example, a curved surface with sensors or a number of surfaces comprising sensors and enclosing angles with one another. The sensors will generally be touched by a user's hand for activation. It is also conceivable, however, that sensors can be influenced not only by actual touching, but also in that a hand is held, for example, at a very close distance above the sensors. This will also be defined as "touching" herein.

The quantity of light emitted by the luminaire during its operation can be influenced in a very simple, user-friendly, and playful manner in a luminaire according to the invention. It stimulates a user to obtain a personally desired lighting effect by means of a manual action.

The light-emitting elements accommodated in the wall of the housing are preferably light-emitting diodes (LEDs). Such light sources have a low power consumption and can be incorporated in the wall of the housing in a simple manner on account of their compactness. LEDs also have the advantage that the colour of the emitted light can be adjusted, which is of benefit in certain special applications.

Preferably, a touching of the wall surface comprising the sensors in multiple directions by a user activates the light-emitting elements in corresponding directions, there being a linear relation between the order in time and space in which the light-emitting elements are activated on the one hand and the speed with which and the locations where the sensors were touched on the other. This embodiment has the advantage that a direct and fast adjustment by a user is possible through touching of the sensors. Among the particular variables that may be influenced are light intensity, colour, beam width, and the dynamism of the emitted light.

The sensors may be provided in a part of the housing of the luminaire that is located at some distance from the light-emitting elements. Preferably, the wall surface comprising the sensors is situated on that side of the housing that faces away from the light emission side. They will then be accommodated in the wall portion that is located behind the light emission side. Operation by a user will then take place directly on the side of the housing located behind the light sources. A user will thus more readily have the feeling that the emitted light is directly attuned to his/her wishes.

The invention will now be explained in more detail with reference to a drawing in which the preferred embodiments of the luminaire according to the invention are diagrammatically depicted. The invention, however, is by no means limited to these embodiments. In the drawing:

FIG. 1 shows a luminaire according to the invention in perspective view;

FIG. 2 diagrammatically shows an embodiment in which the sensor surface is touched by the fingers of a hand; and FIG. 3 shows, also diagrammatically, an embodiment in which the colour of the emitted light is influenced.

The luminaire of FIG. 1 comprises a semitransparent synthetic resin housing 1 with light-emitting elements (inorganic LEDs) 2 located near a light emission side 3 of the housing. They are activated in that a user touches a group of sensors 4 which are accommodated in the rear wall of the housing and which are arranged in a matrix over the slightly curved surface thereof. The number of LEDs to be activated by a user is proportional to the size of the wall surface comprising sensors that is touched by the user. The user him/herself makes the desired adjustment, for example by directing a wide beam or a comparatively narrow beam at an object. The housing is provided with a base 5 with which it can be placed, for example, on a table. The sensors are sensitive to touching and are grouped in a multidimensional manner, as are the LEDs. The light emission side 3 and the other side 4 of the housing are both slightly curved. The wall surface comprising the sensors is sensitive to touching in several directions, and the light-emitting elements are activated in the corresponding directions. This will be discussed in more detail with reference to FIGS. 2A to 2C.

Figure 2A:
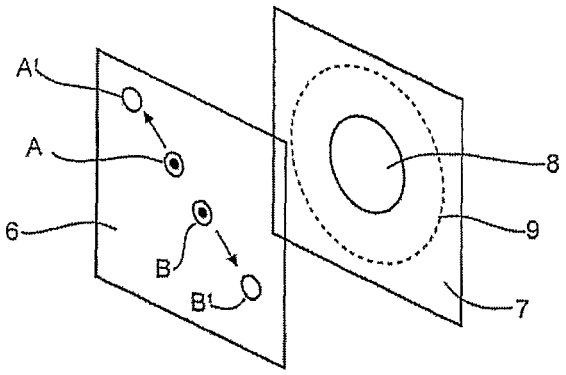
Figure 2B:
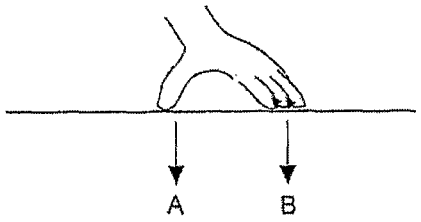

It is diagrammatically depicted in FIG. 2A how touching of the surface 6 comprising the sensors activates the light-emitting portion of the surface 7 situated at the other side of the housing. Placing the fingers of a hand (for example thumb and index finger, cf. FIG. 2B) on two spots A and B located at a short distance from one another indicates the size of the light-emitting portion 8 of the surface 7. The diameter of the portion 8 is defined by the distance between A and B on the surface 6. When the distance between A and B is increased (i.e. the distance between thumb and index finger is increased by the user dragging them over the surface), the light-emitting portion in the surface 7 will increase to a size referenced 9. The increase in the distance has been indicated with two arrows up to the points where the distance between A' and B' corresponding to the size 9 is reached. The width of the beam of the light emitted by the LEDs is thus adjusted in that the wall surface comprising the sensors is touched with two or more fingers of a hand, the distance between which is changed by the user.

The width of the beam of the light emitted by the light-emitting elements is coupled to the greatest distance between sensors on the surface touched by the user.

In an alternative embodiment, the beam is not influenced by an increase in the distance between the thumb and one or more fingers, but by a repeated touching of the sensors ("iterative pinching", whereby the diameter of the beam is increased or reduced, for example, in that the sensor surface is repeatedly touched with two fingers on the same starting point at intervals). The increase of the light-emitting portion 8 of the surface 7 then is proportional to the increase in the distance A-B or to the speed of that increase, and vice versa.

Figure 2C:
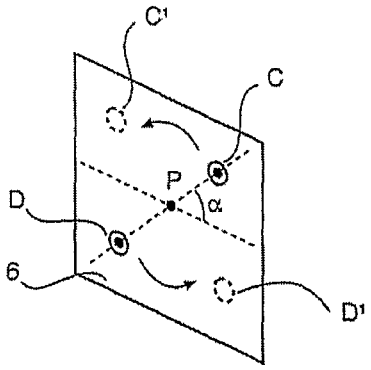

In the embodiment of FIG. 2C, the surface 6 is shown on which the intensity of the light emitted by the light-emitting elements is increased or decreased in dependence on a direction of rotation (from C to C' or from D to D', respectively, as indicated by the arrows) by means of a circular movement executed by the fingers of a hand around a virtual point P on the wall surface comprising the sensors. The brightness will then be dependent on the value of the angle $\alpha$.

In a special embodiment with RGB LEDs, the colour of the emitted light of these RGB LEDs may be set and modified by means of this circular movement.

In another embodiment, the light-emitting elements on the surface 7 are switched off by means of a quick up-and-down touching movement of the hand on or near the wall surface 6. No further switches (such as in the base of the luminaire) are then necessary for this purpose.

The sensors in the surface 6 are constructed as pressure sensors in an embodiment. The intensity or the width of the light beam can now be influenced by briefly pressing somewhat harder with the thumb while the pressure exerted on the sensors by the other fingers of the hand is kept constant. This may also be achieved with the use of proximity sensors.

Figure 3A:
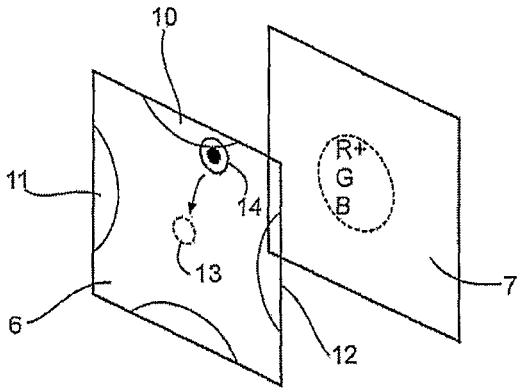

FIG. 3A shows an embodiment of the luminaire according to the invention wherein a user can manually set a certain colour. A portion of the wall surface comprising the sensors 6 is coupled to one or more RGB LEDs which each emit light of a certain colour during operation. The colour can be integrated with a colour emitted by other elements during their operation in that the hand is dragged over the wall surface comprising the sensors. The intensity of the emitted coloured light can also be set during this.

The touch surface 6 has portions 10, 11, and 12 which act as sources for, for example, three primary colours (RGB). Thus the colour red may be coupled to the portion 10, the colour green to 11, and the colour blue to 12. The portion of the surface that is coupled to a portion that emits white light is referenced 13. When a finger performs a movement over the sensor surface from location 14 to location 13 (in the direction of the arrow), more red light can be admixed. This is indicated as R+, G, and B in the surface 7. Conversely, the contribution of the colour red in the white light can be reduced in that, starting from 13, the finger is moved over the surface in the direction of 14.

Figure 3B:
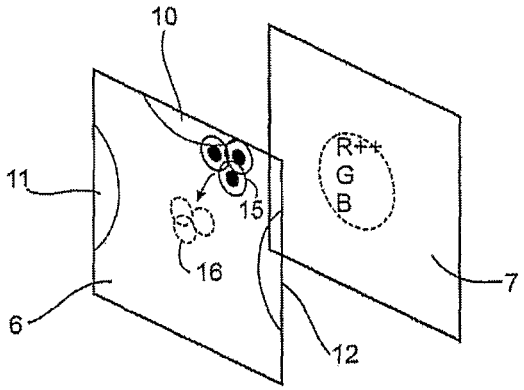

FIG. 3B shows a situation similar to that in FIG. 3A, but with an added possibility: by increasing the surface area that is touched in the red portion 10 a proportional increase of the red component in the emitted light can be realised. This is indicated by three touch points 15 that are moved in the direction of 16. The result in the surface 7 is represented as R++, G, and B.

In a special embodiment, the input upon touching of the sensors is stored in a memory. A movement over the sensor surface is registered in the memory, for example, at the start and the start location up to the moment and location of release. It is also possible to effect a registration in the memory if the finger or hand is held on the sensor surface for a short period only and is subsequently removed again.

In another embodiment, an activation of the sensors is stored in the memory, for example, in that fingers are moved over a portion of the sensor surface. The sensors are activated anew via a program stored in the memory in that a hand is held for some time at a short, detectable distance from the "programmed" sensor surface while making a reciprocating movement. This is denoted "reproducing" in this context.

Other quantities may also be registered in the memory, such as sensor actions for changing the beam width, the intensity, and/or the colour of the emitted light, and the like.

The invention claimed is:

1. A luminaire including a housing, comprising:

a light emitting portion within the housing, the light emitting portion having a light emission side including a plurality of light emitting diodes (LEDs);

a wall surface part arranged within the light emitting portion of the housing and having a plurality of touch sensitive sensors;

wherein each of said plurality of LEDs is activated when a user directly touches a corresponding one of said plurality of touch sensitive sensors accommodated in said wall surface part of the housing, wherein said plurality of sensors are arranged multidimensionally, and wherein during at least some use, the number of activated LEDs corresponds to the size of said wall surface part comprising the plurality of sensors being touched by the user, wherein the wall surface part comprising the plurality of sensors is situated on a side of the housing that is behind, and faces away from, the light emission side, and wherein the luminaire is configured such that the wall surface part and the plurality of sensors are touchable by the user.

2. The luminaire according to claim 1, wherein a touching in multiple directions of the wall surface part comprising the plurality of touch sensitive sensors by a user activates the LEDs in corresponding directions, there being a linear relation between the speed with which and the locations where the sensors were touched by said user and the order in time and space respectively in which the LEDs are activated.

3. The luminaire according to claim 1, wherein a width of a beam of light emitted by the LEDs is adjustable through touching of said wall surface part comprising the plurality of touch sensitive sensors in at least two spots located at a distance from one another such that the width of the beam is adjusted by varying said distance between said at least two spots by the user.

4. The luminaire according to claim 3, wherein the width of the beam of light emitted by the LEDs corresponds to the greatest distance between the sensors on the surface being touched by the user.

5. The luminaire according to claim 1, wherein a beam width, an intensity, and/or a colour of the light emitted by the LEDs is adjustable in that the wall surface part is touched in a repetitive manner.

6. The luminaire according to claim 1, wherein an intensity of the light emitted by the LEDs is increased or decreased by means of a circular touching movement around a virtual point (P) on the wall surface comprising the plurality of touch sensitive sensors in dependence on a direction of rotation (a) during said circular touching movement.

7. The luminaire according to claim 1, wherein the plurality of touch sensitive sensors are pressure sensors.

8. The luminaire according to claim 1, wherein the LEDs are switched off by a movement of a hand of said user adjacent to the wall surface part comprising the plurality of touch sensitive sensors.

9. The luminaire according to claim 1, wherein at least a portion of the wall surface part comprising the plurality of touch sensitive sensors is coupled to at least a subset of LEDs of the plurality of LEDs which each emit light of a certain colour during operation, which colour is integrated with a colour emitted by LEDs other than said subset during their operation by dragging the user's finger along the wall surface part comprising the plurality of touch sensitive sensors.

10. The luminaire according to claim 9, wherein an intensity of the emitted coloured light is adjustable.

11. The luminaire according to claim 1, wherein the touching movement of the user's finger at a detectable distance over a portion of the wall surface part comprising the plurality of touch sensitive sensors is registered and stored in a memory, after which the quantities stored in the memory are reproducible.

* * * * *